US006254434B1

(12) United States Patent
Steeves

(10) Patent No.: US 6,254,434 B1
(45) Date of Patent: Jul. 3, 2001

(54) FUSE BYPASS MODULE FOR USE WITH A FUSE PANEL

(75) Inventor: Michael C. Steeves, Richardson, TX (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/226,579

(22) Filed: Jan. 7, 1999

(51) Int. Cl.[7] ..... H01R 13/68

(52) U.S. Cl. ..... 439/621; 439/825; 439/833; 439/837; 361/628; 361/630

(58) Field of Search ..... 361/825, 833, 361/837, 115, 636, 646, 656, 104; 337/198, 194; 439/621, 622, 34

(56) References Cited

U.S. PATENT DOCUMENTS 5,841,337 * 11/1998 Douglass ..... 337/198

5,951,328 * 9/1999 Roper, Jr. ..... 439/621

* cited by examiner

*Primary Examiner*—Gary F. Paumen
*Assistant Examiner*—Alexander Gilman

(57) ABSTRACT

The present invention is directed to a fuse bypass module that may be used with a corresponding fuse panel. The fuse bypass module may be used with a primary fuse receptacle, located on the fuse panel. The primary fuse receptacle has terminals coupled to a power source and a load, respectively. In one embodiment, the a fuse bypass module may be used with a primary fuse receptacle having terminals coupled to a power source and a load, respectively. In a particularly advantageous embodiment, the fuse bypass module comprises a housing that has a bypass fuse receptacle for receiving a bypass fuse. Additionally, the fuse bypass module includes an electrical connector on the housing that is electrically coupled to the bypass fuse and that is removably couplable to a fuse panel electrical connector, which is associated with the bypass fuse panel. The fuse bypass module is couplable to the fuse panel to allow the bypass fuse receptacle to be coupled in parallel with a primary fuse and further allow the primary fuse to be removed without interrupting power to the load.

10 Claims, 3 Drawing Sheets

FUSE BYPASS MODULE FOR USE WITH A FUSE PANEL

TECHNICAL FIELD OF THE INVENTION

The present invention is directed, in general, to a bypass fuse for use with a fuse panel and, more specifically, to a fuse bypass module.

BACKGROUND OF THE INVENTION

Telephone and other telecommunications circuits operate in an environment where they occasionally may become subjected to an unexpectedly high current that could be injurious to the user or to equipment, unless electrical protection is provided. Fuses and circuit breakers are the usual methods used to provide such protection. The fuse or circuit breaker is installed in the circuit in order to interrupt the circuit before a harmful current reaches protected users and equipment.

Uninterrupted telephone and telecommunications service is an important feature that phone customers have come to expect and demand. While a telecommunications customer will accept a service interruption for safety reasons, an interruption for nearly any other reason is unacceptable. This includes any interruption that may be required for service and maintenance purposes. In order to provide this quality of service, certain levels of redundancy are required in order to provide protection circuitry for telecommunications equipment.

Redundant protection circuitry is required because fuses frequently must be replaced during the course of providing normal service and maintenance while operating telecommunications systems. For example, fuses frequently must be replaced due to changing customer requirements. When customers change their requirements, the usual result is that the circuit load also changes. If there is a change in the circuit load, the fuse must be replaced with one having the correct amperage rating for the new load being carried. The only way to replace the fuse with one of the correct amperage, without causing a service interruption, is to provide a backup fuse that provides circuit protection while the primary fuse is being replaced.

A telecommunication or telephone circuit is usually routed through a central office or centralized maintenance facility where the fuse protection circuitry is located. The prevailing practice is to provide each telecommunication or telephone circuit with two permanently mounted fuses and a switch. One of the fuses is a primary fuse to provide circuit protection during normal operations, while the other is a backup fuse, the sole purpose of which is to provided circuit protection while the primary fuse is being replaced.

In order to change the primary fuse, the switch is manually activated to reroute the telephone circuit to flow through the backup fuse. Service is not interrupted because the switch is activated in a "make-before-break" application. After the primary fuse has been replaced, the switch is again engaged in a "make-before-break" application to restore the telephone circuit to flow through the primary fuse.

There is an additional cost in providing uninterrupted service of the type described. Such cost is found primarily in the number of components, such as duplicate fuses, required to provide continuous protection and in larger facilities necessary to accommodate the cabinets and panels where the fuses and switches are housed or mounted. Such additional costs are significant. If a single fuse protection system could be used to protect each telephone circuit, while still permitting service and maintenance personnel to change a fuse without causing a service interruption, the number of components would be reduced and less space would be required to house the system. If fewer components could be used and less space was required to house the circuitry, the cost of providing a protection system would be reduced. Such a cost reduction would eventually redound to the customer's benefit.

Accordingly, what is needed in the art is a single fuse method to protect a telephone circuit that will permit the replacement of a primary fuse without causing a service interruption, while simultaneously maintaining necessary protection to users and equipment.

SUMMARY OF THE INVENTION

To address the above-discussed deficiencies of the prior art, the present invention provides a fuse bypass module that may be used with a primary fuse receptacle having terminals coupled to a power source and a load, respectively. In a particularly advantageous embodiment, the fuse bypass module comprises a housing that has a bypass fuse receptacle for receiving a bypass fuse. Additionally, the fuse bypass module includes an electrical connector on the housing that is electrically coupled to the bypass fuse and that is removably couplable to a fuse panel electrical connector, which is associated with the bypass fuse panel. The fuse bypass module is couplable to the fuse panel to allow the bypass fuse receptacle to be coupled in parallel with a primary fuse and further allow the primary fuse to be removed without interrupting power to the load.

Thus, this particular embodiment provides a portable fuse module that can be used to replace a fuse in a power system without interrupting the flow of power to the system. This particular embodiment, therefore, does not require the costly switch mechanisms currently found in conventional fuse panels. Furthermore, because the bypass fuse is in modular form, it need only be in place when a primary fuse needs to be replace. As such, the fuse panel can be manufactured more compactly, thereby allowing a manufacturer the opportunity to increase the fuse panel density within any given housing.

Another aspect of the present invention provides a fuse panel that comprises a fuse mounting bracket, a primary fuse receptacle and a fuse panel electrical connector. The fuse panel electrical connector is supported by the fuse mounting bracket and electrically coupled to the primary fuse receptacle. The fuse panel electrical connector is removably couplable to an electrical connector of a fuse bypass module to allow the bypass fuse module to be coupled in parallel with a primary fuse in the primary fuse receptacle and further allow the primary fuse to be removed without interrupting power to the load.

In yet another aspect, the present invention provides a make-before-break system for changing a fuse in a fuse panel. This particular embodiment comprises a fuse bypass module that includes the following components: a housing having a bypass fuse receptacle for receiving a bypass fuse and an electrical connector on the housing that is electrically coupled to the bypass fuse and removably couplable to a fuse panel electrical connector that is associated with the bypass fuse panel. The fuse bypass module is couplable to the fuse panel to allow the bypass fuse receptacle to be coupled in parallel with a primary fuse and further allow the primary fuse to be removed without interrupting power to the load. The make-before-break system further includes a fuse panel. The fuse panel includes the following components: (3*a*) a fuse mounting bracket, (3*b*) a primary fuse receptacle that is mounted to the fuse mounting bracket and that has terminals coupled to a power source and a load, respectively, and (3*c*) the fuse panel electrical connector is supported by the fuse mounting bracket and electrically coupled to the primary fuse receptacle. The fuse panel electrical connector is removably couplable to an electrical connector of a fuse bypass module to allow the bypass fuse module to be coupled in parallel with a primary fuse in the primary fuse receptacle and further allow the primary fuse to be removed without interrupting power to the load.

Yet another aspect of the present invention provides a method for changing a fuse in a fuse panel. In this particular embodiment, the method comprises coupling an electrical connector on a bypass fuse module to a fuse panel electrical connector on a fuse panel. The coupling step electrically connects a bypass fuse, which is supported by the bypass fuse module, in parallel with a primary fuse coupled to a power source and a load. The method further includes removing the primary fuse from a primary fuse receptacle without interrupting power to a load, inserting a replacement primary fuse in the primary fuse receptacle, and removing the bypass fuse from the primary fuse by uncoupling the bypass fuse module from the fuse panel electrical connector.

The foregoing has outlined, rather broadly, preferred and alternative features of the present invention so that those who are skilled in the art may better understand the detailed description of the invention that follows. Additional features of the invention are described hereinafter that form the subject of the claims of the invention. Those who are skilled in the art should appreciate that they can readily use the disclosed conception and specific embodiment as a basis for designing or modifying other structures for carrying out the same purposes of the present invention. Those who are skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
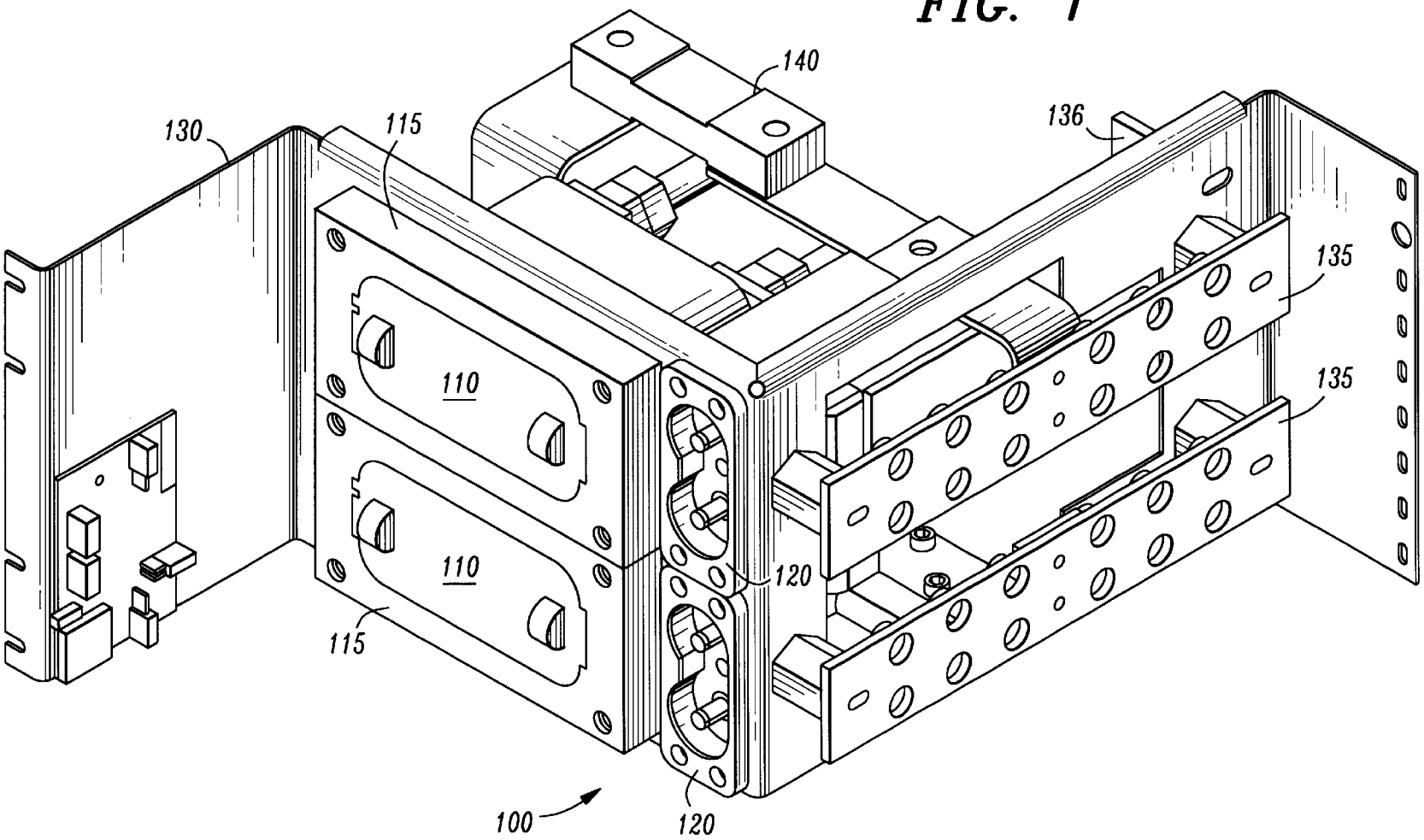
FIG. 1 illustrates a fuse panel designed to be used with an embodiment of the present invention.

Referring initially to FIG. 1, illustrated is a fuse panel 100 designed to be used with an embodiment of the present invention. The illustrated fuse panel 100 may be used in various power systems. However, in one particularly advantageous embodiment, the fuse panel 100 is designed to provide the protection circuitry for two telephone circuits. Primary power is routed through the fuse panel 100 by way of a bus bar 135 for each telephone circuit. In addition to providing the route for primary power to connect to the fuse panel 100, each bus bar 135 also provides routing to the fuse panel 100 for the battery backup 160 power.

In one illustrative embodiment, the fuse panel 100 has a fuse mounting bracket 130 to which a primary fuse receptacle 115 is attached. The primary fuse receptacle 115 has two terminals. One terminal is coupled to a load, provided via the bus bar 135, and the other is connected to a power source, via the load shunt 140. Installed in the primary fuse receptacle 115 is a primary fuse 110 that provides electrical protection for a telephone circuit. One terminal of the primary fuse 110 is connected to the power source through the power source connection of the primary fuse receptacle 115. The primary fuse's 110 other terminal is connected to the load by way of the primary fuse receptacle's 115 connection to the load.

In this illustration, the load is the telephone circuit that the primary fuse 110 is protecting. Depending on the requirements of a particular circuit's load, the size of the primary fuse 110 will generally have a protection rating of between 70 and 600 Amps. Because, as noted above, telephone customers frequently change their telecommunications requirements, the size of the load being carried on a specific telephone circuit will also change. If the load being carried is changed, the size of the primary fuse 110 size must be changed to one having the correct rating to protect the changed load. The invention described herein provides a mechanism and a method to change the primary fuse 110, without interrupting service or impairing the electrical protection normally provided by the primary fuse 110. Other power distribution systems that also employ such fuse panels and that require fuse replacement, whether for upgrade or wear-out, are also within the scope of the present invention.

Figure 2A:
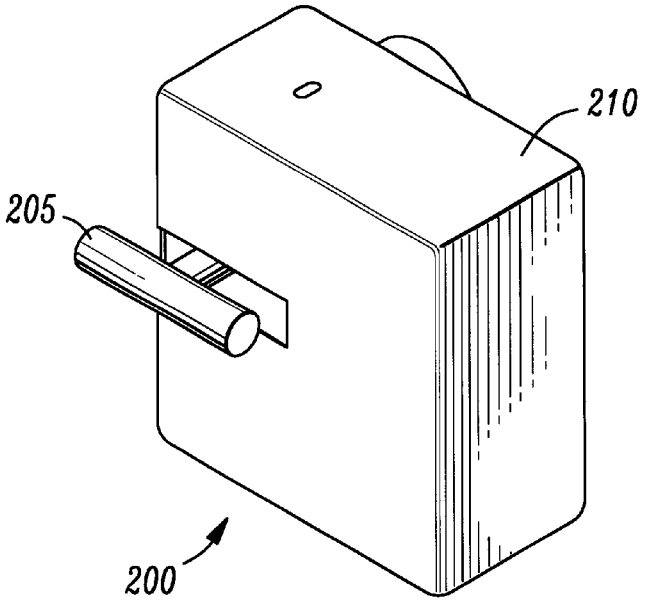
FIGS. 2A and 2B illustrate front and rear isometric views of a fuse bypass module.
Figure 2B:
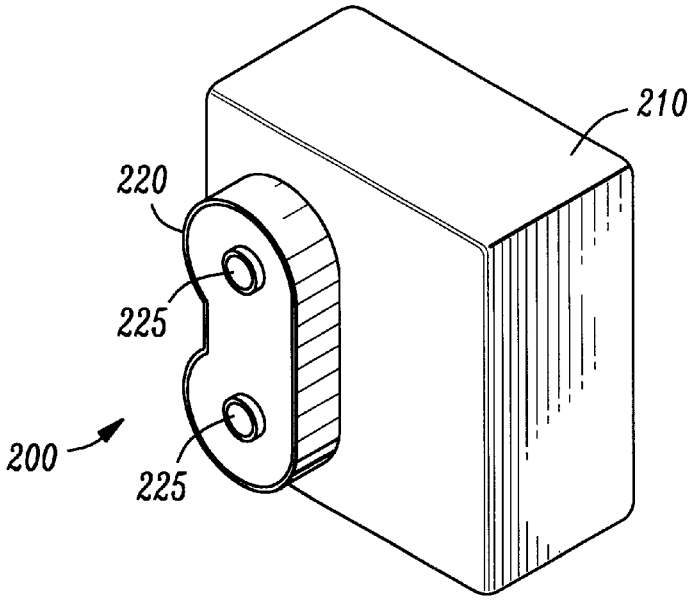

Turning now to FIGS. 2A and 2B, front and rear isometric views of a unique fuse bypass module 200 are illustrated. This module 200 is the tool that, when used in association with certain fuse panel 100 features (hereinafter described), permits the primary fuse 110 to be changed without a service or protection interruption. The housing 210 of the fuse bypass module 200 encloses a bypass fuse receptacle (not shown) that receives a bypass fuse (not shown). In a particular advantageous embodiment of the module 200, the housing 210 has a removable cover 210*a* that permits access to the interior of the housing 210. This feature permits service and maintenance personnel access to the bypass fuse contained in the housing 210 in order to replace a bypass fuse of one amperage rating with one of a different amperage rating. The size of the bypass fuse used will depend on the circuit load of the primary fuse 110 being replaced.

The module 200 has an electrical connector 220 on the housing 210 that is electrically coupled to the bypass fuse. Electrical interface connector receptacles 225 connect the bypass fuse receptacle to each terminal of the bypass fuse. In one embodiment the pitch of the electrical interface connector receptacles 225 is two inches.

Turning again to FIG. 1, the fuse panel 100 has a fuse panel electrical connector 120, that permits the fuse bypass module 200 to be removably coupled to the fuse panel 100. In the particular embodiment illustrated, the fuse panel electrical connector 120 is located adjacent to the primary fuse receptacle 115 with which it is associated. Those who are skilled in the art will recognize that the fuse panel electrical connector 120 can be mounted in other locations and in other configurations.

When the module electrical connector 220 located on the housing 210 is plugged into the fuse panel electrical connector 120, the bypass fuse receptacle is coupled in parallel with the primary fuse 110. When thus coupled, the primary fuse 110 can be removed without a circuit interruption. The circuit is still safe because circuit protection is taken over by the bypass fuse contained in the module 200. After the primary fuse 110 is replaced, the module 200 is removed and the circuit is restored to go through the primary fuse 110. In the illustrated embodiment of the module 200, a handle 205 may also be provided for the convenience of service and maintenance personnel in coupling and removing the module 200 from the fuse panel 100, if so desired.

Those who are skilled in the art will understand that it is within the scope of this invention to reverse the types of electrical connectors on the fuse bypass module 200 and the fuse panel 100. Those who are skilled in the art will also recognize that the method of providing a bypass fuse in order to change the primary fuse 110 described herein constitutes a make-before-break system.

A particular advantage of the present invention is readily apparent in the fuse panel 100 illustrated in FIG. 1. The illustrated fuse panel 100 provides the primary fuse 110 protection for two circuits, such as telephone circuits. Prior art systems required two fuses, a primary and a backup, together with a switch, for each circuit, all of which were permanently mounted. Such a prior art system would require about the same space for one telephone circuit as the space required for two circuits if the present invention is used. Of course a number of fuse panels 100 of the type illustrated may be combined into, for example, a telephone system by stacking or mounting them in a cabinet or on a panel. As thus configured, ready access by maintenance personnel is provided for servicing purposes but less space is required and fewer total components are used. Additionally, the present invention provides a fuse module that can be easily carried from one job site to another.

Figure 3:
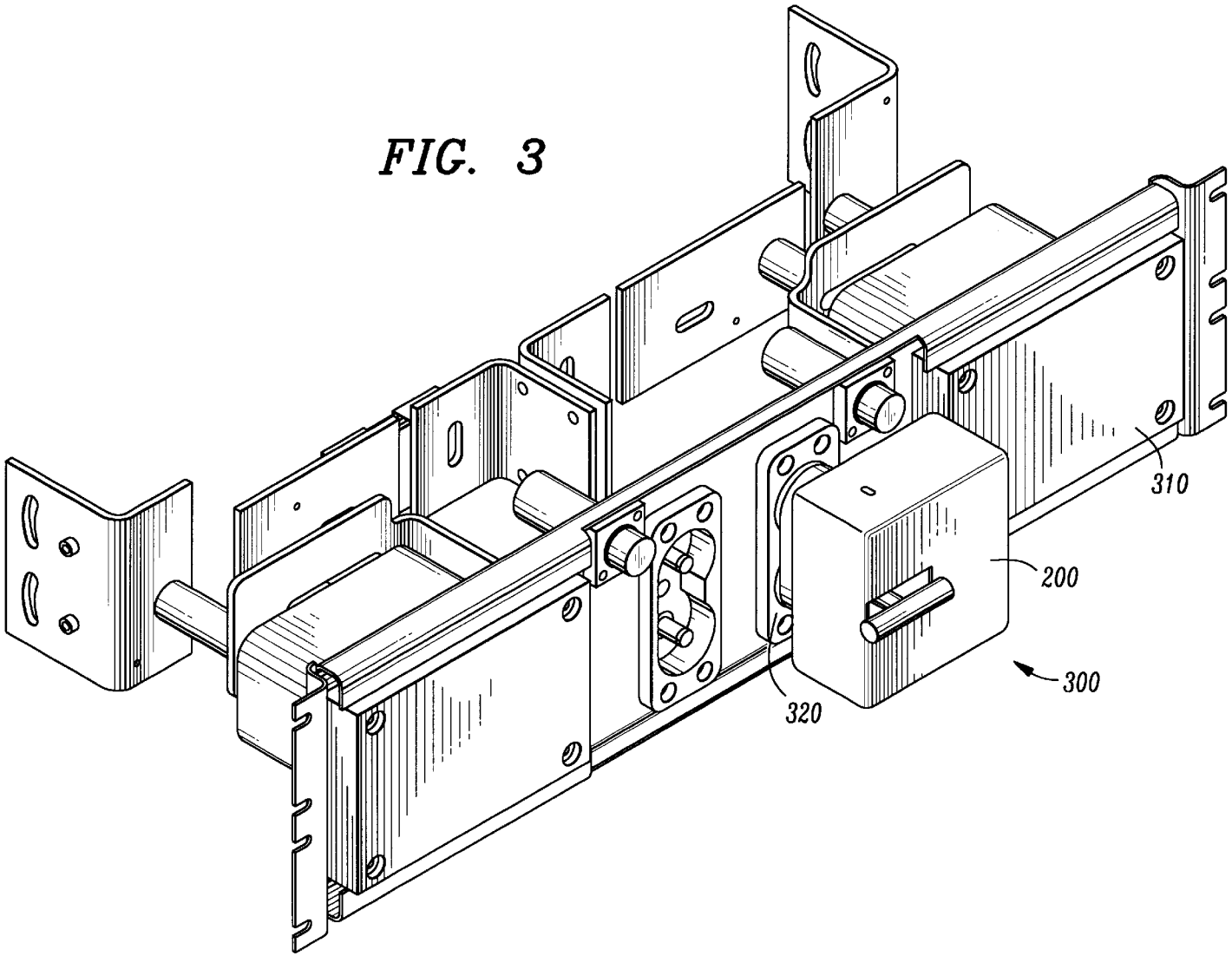
FIG. 3 illustrates an alternate embodiment of a fuse panel.

Turning now to FIG. 3, illustrated is an alternate embodiment of a fuse panel 300. This embodiment also supports two power protection circuits with a primary fuse 310 associated with each circuit. A number of fuse panels 300 using this embodiment can also be stacked and mounted on a panel or within a cabinet to provide circuit protection for a power system, such as a telephone or telecommunications system. Each primary fuse 310 has a corresponding fuse panel electrical connector 320 associated with it that is configured to receive the fuse bypass module 200. The fuse bypass module 200 is illustrated as plugged into one of the fuse panel electrical connectors 320. This means that the primary fuse 310 associated with the fuse panel electrical connector 320 into which the module 200 is plugged has been bypassed in a make-before-break application and the associated primary fuse 310 can be removed and replaced without a service or protection interruption. After the primary fuse 310 is replaced, the module 200 is removed and the circuit is restored to its original route.

From the foregoing, it is readily apparent that the present invention provides a fuse bypass module that may be used with a primary fuse receptacle having terminals coupled to a power source and a load, respectively. The fuse bypass module comprises a housing that has a bypass fuse receptacle for receiving a bypass fuse. Additionally, the fuse bypass module includes an electrical connector on the housing that is electrically coupled to the bypass fuse and that is removably couplable to a fuse panel electrical connector, which is associated with the bypass fuse panel. The fuse bypass module is couplable to the fuse panel to allow the bypass fuse receptacle to be coupled in parallel with a primary fuse and further allow the primary fuse to be removed without interrupting power to the load.

Although the present invention has been described in detail, those who are skilled in the art should understand that they can make various changes, substitutions and alterations herein without departing from the spirit and scope of the invention in its broadest form.

What is claimed is:

1. A make-before-break system for changing a fuse in a fuse panel, comprising:

a fuse bypass module, including:

a housing having a bypass fuse receptacle for receiving a bypass fuse;

an electrical connector on said housing electrically coupled to said bypass fuse and removably couplable to a fuse panel electrical connector associated with a fuse panel, said fuse bypass module couplable to said fuse panel to allow said bypass fuse receptacle to be coupled in parallel with said primary fuse and further to allow said primary fuse to be removed without interrupting power to said load; and a fuse panel, including:

a fuse mounting bracket;

a primary fuse receptacle mounted to said fuse mounting bracket and having terminals coupled to a power source and a load, respectively; and a fuse panel electrical connector supported by said fuse mounting bracket and electrically coupled to said primary fuse receptacle, said fuse panel electrical connector removably couplable to said electrical connector of said fuse bypass module to allow said bypass fuse module to be coupled in parallel with a primary fuse in said primary fuse receptacle and further allow said primary fuse to be removed without interrupting power to said load.

2. The make-before-break system as recited in claim 1 wherein said fuse bypass module further includes electrical interface connector receptacles.

3. The make-before-break system as recited in claim 2 wherein a pitch of said interface connector receptacles is two inches.

4. The make-before-break system as recited in claim 1 wherein said housing further comprises a handle attached to said housing to allow said fuse bypass module to be coupled to and uncoupled from said primary fuse receptacle.

5. The make-before-break system as recited in claim 1 wherein said housing further includes a removable cover to allow access to an interior of said housing.

6. A method for changing a fuse in a fuse panel, comprising:

coupling an electrical connector on a bypass fuse module to a fuse panel electrical connector on a fuse panel, said coupling electrically connecting a bypass fuse, supported by said bypass fuse module, in parallel with a primary fuse coupled to a power source and a load;

removing said primary fuse from a primary fuse receptacle without interrupting power to a load;

inserting a replacement primary fuse in said primary fuse receptacle; and removing said bypass fuse from said primary fuse by uncoupling said bypass fuse module from said fuse panel electrical connector.

7. The method as recited in claim 6 wherein coupling an electrical connector on a bypass fuse module to a fuse panel electrical connector includes coupling said bypass fuse module to said fuse panel electrical connector by electrical interface connector receptacles associated with a housing of said bypass fuse module.

8. The method as recited in claim 7 wherein a pitch of said electrical interface connector receptacles is two inches.

9. The method as recited in claim 6 further comprising the step of inserting a bypass fuse in said bypass fuse module prior to coupling said bypass fuse module to a fuse panel electrical connector, said bypass fuse capable of carrying an amperage equal to or greater than said primary fuse.

10. The method as recited in claim 9 further comprising removing a cover from a housing of said bypass module to allow access to an interior of said housing for inserting a fuse in said bypass module.

* * * * *